US006893119B2

(12) United States Patent
Ushiro

(10) Patent No.: US 6,893,119 B2
(45) Date of Patent: May 17, 2005

(54) EXPENDABLES UNIT, EQUIPMENT, AND PRINTER

(75) Inventor: Seimei Ushiro, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 129 days.

(21) Appl. No.: 10/631,807

(22) Filed: Aug. 1, 2003

(65) Prior Publication Data

US 2004/0021750 A1 Feb. 5, 2004

(30) Foreign Application Priority Data

Aug. 2, 2002 (JP) ..... 2002-225586

(51) Int. Cl.[7] ..... B41J 2/175; B05D 5/12
(52) U.S. Cl. ..... 347/86; 427/115
(58) Field of Search ..... 347/85–86, 87, 347/109, 103; 427/115; 429/40–43; 502/101

(56) References Cited

U.S. PATENT DOCUMENTS 6,149,256 A * 11/2000 McIntyre et al. ..... 347/2
6,667,268 B1 * 12/2003 Sugawara et al. ..... 502/101

FOREIGN PATENT DOCUMENTS

| | | | |
|---|---|---|---|
| JP | 10-105295 | A | 4/1998 |
| JP | 2001-125646 | A | 5/2001 |
| JP | 2001-301196 | A | 10/2001 |
| JP | 2002-127391 | A | 5/2002 |

* cited by examiner

*Primary Examiner*—Anh T. N. Vo
(74) *Attorney, Agent, or Firm*—Sughrue Mion, PLLC

(57) ABSTRACT

In a printer incorporating thereinto a fuel cell for generating electricity upon receipt of supply of liquid fuel, an ink cartridge storing ink is mounted on a carriage, and the ink stored in the ink cartridge is ejected to a recording medium so that an image is recorded on the recording medium. The ink cartridge stores ink, and has a liquid fuel storage section that stores the liquid fuel, and a water storage section that stores water. The printer has: the fuel cell having a fuel electrode, an air electrode, and a solid-electrolyte film, in which the fuel electrode receives the liquid fuel and water is discharged through the air electrode; a fuel supplying path for supplying the liquid fuel stored in the liquid fuel storage section to the fuel electrode; and a water forwarding path for forwarding the water discharged from the air electrode to the water storage section.

13 Claims, 8 Drawing Sheets

EXPENDABLES UNIT, EQUIPMENT, AND PRINTER

BACKGROUND OF THE INVENTION

1. Field of the Invention

The present invention relates to: equipment incorporating thereinto a fuel cell for generating electricity upon receipt of supply of liquid fuel, in which an expendables unit having expendables is mounted to supply expendables, and the equipment is operative by electric power from the fuel cell involving consumption of the expendables from the expendables unit; a printer, as an example of such equipment, incorporating thereinto a fuel cell, in which an ink cartridge accommodating ink as expendables is mounted to supply the ink, and the printer is operative by electric power from the fuel cell upon receipt of supply of the ink from the ink cartridge; and an expendables unit mounted on the above-mentioned equipment for supplying expendables to the equipment.

2. Description of the Related Art

Hitherto, there are developed various types of equipment which are operative as expendables loaded thereon are consumed, and such various types of equipment are used in various fields. Here, there will be explained an ink jet type of printer on behalf of those various types of equipment.

Recently, an ink jet type of printer using an ink cartridge rapidly comes into wide use in view of the fact that coloring technology advances and the use of the ink jet type of printer makes it possible to obtain a relatively clear color image with compactness and at low price.

Generally, an ink jet type of printer has a carriage supported by a guide bar on a slidable basis. In such ink jet type of printer, a plurality of ink cartridges storing a plurality of colors of ink is detachably mounted on the carriage, and ink stored in the ink cartridge is ejected from a recording head provided on the carriage by a film boiling force based on a driving signal, so that a color image is formed on a blank form (cf. Japanese Patent Application Laid Open Gazette Tokukai. No. 2001-301196 (Page 3, FIG. 7), for example).

However, since an ink cartridge merely stores ink on the order of several ml or so, when a large amount of images is recorded, it happens that the ink runs short and thus a printing is interrupted. In view of the foregoing, there is proposed a system for taking care of an amount of consumed inks in such a manner that a memory circuit is incorporated into the respective cartridge and an antenna is provided, and a control unit of the main frame of the printer is connected to the antenna on a radio basis (cf. Japanese Patent Application Laid Open Gazette Tokukai. No. 2002-127391 (Pages 2–3, FIG. 4), for example).

Further, in the event that required conditions for the image quality are varied between a business document and a photographic document in connection with contents to be printed, there is proposed a system capable of printing an image excellent in tone property without needs of the exchange into ink cartridges storing lower density of ink and the addition of the same in such a manner that a residue memory, a refill start memory and a refill over memory are provided on an ink cartridge, and a reducer is injected to dilute the ink into a desired density (cf. Japanese Patent Application Laid Open Gazette Tokukai. No. 2001-301196 (Pages 2–3, FIG. 1), for example).

Recently, there is developed a high energy density of secondary battery such as a nickel-cadmium battery and a lithium battery, there is advanced mobiling of electronic equipment such as a portable telephone, a video camera, a digital camera, a notebook-sized personal computer, and a electronic note, and there is developed a personal computer with a built-in printer by a battery driving. In order to prevent an interruption of printing due to exhaustion of a battery and also to prevent the loss of printing data due to exchange of batteries, there is proposed a personal computer with a built-in printer capable of deciding the propriety of printing through computing the necessary amount of electric power in accordance with a battery residue and an amount of printing data (cf. Japanese Patent Application Laid Open Gazette Tokukaihei. No. 10-105295 (Paragraphs 0001–0008), for example).

While the proposed personal computer with a built-in printer can prevent an interruption of printing and the loss of printing data, it involves such a troublesomeness that batteries are exchanged whenever a battery is exhausted, and it is difficult to continuously carry out a printing over a long time.

Nowadays, as an energy conversion system of high conversion efficiency, which is extremely less in air pollution, a fuel cell is noticed. As the fuel cell, there are raised: a solid oxide fuel cell of about 1000° C. in an operating temperature, wherein as an electrolyte, an oxide ion conductive solid-electrolyte is used; a phosphoric acid fuel cell of about 200° C. in an operating temperature, wherein as an electrolyte, a phosphoric acid water solution is used; a molten carbonate fuel cell of about 600° C. in an operating temperature, wherein as an electrolyte, a molten carbonate is used; a polymer electrolyte fuel cell of room temperature in an operating temperature, wherein as an electrolyte, a solid polymer is used. Of those sorts of fuel cell, as a fuel cell for mobile equipment, there is noticed the polymer electrolyte fuel cell of room temperature in an operating temperature. The polymer electrolyte fuel cell is of small and light, and is capable of obtaining high energy density Particularly, a direct methanol fuel cell, which needs no reforming to hydrogen, and is capable of generating electricity by means of directly supplying liquid methanol to electrodes, is excellent in the points that no reformer is needed and it is permitted that methanol, which is inexpensive and is easy in handling, is used as direct fuel. At the present time that utilization of the direct methanol fuel cell to portable electronic equipment is scrutinized, the direct methanol fuel cell involves technical problems to be solved, such as a development of film materials bringing about no so-called crossover phenomenon that methanol passes through a solid-electrolyte film without a reaction on a fuel electrode, or a development of means bringing about no crossover phenomenon, and a prevention from poisoning of catalyst (platinum) at the fuel electrode side due to carbon monoxide that is an intermediate product in the fuel electrode. It is believed, however, that those problems will be solved in near future.

As one of uses of the fuel cells, it is considered that a fuel cell is loaded onto a printer (cf. Japanese Patent Application Laid Open Gazette Tokukai. No. 2001-125646 (Paragraphs 0089), for example).

However, for example, in the event that equipment such as the above-mentioned ink jet printer is driven by a fuel cell, in case of the polymer electrolyte fuel cell, water is discharged from an air electrode. This involves a problem as to how the discharged water is processed. Further, in this case, there are also associated with problems as to where fuel to be supplied to the fuel electrode is stored, and as to how a residue of the stored fuel is detected to refuel.

SUMMARY OF THE INVENTION

In view of the foregoing, it is an object of the present invention to provide: equipment capable of operating for long time even at a place wherein a commercial power is not available in a train for instance; a printer, as an example of such equipment; and an expendables unit suitable for the above-mentioned equipment.

To achieve the above-mentioned objects, the present invention provides an expendables unit mounted on equipment incorporating thereinto a fuel cell for generating electricity upon receipt of supply of liquid fuel, in which the equipment is operative by electric power from the fuel cell involving consumption of expendables, the expendables unit supplying the expendables to the equipment, wherein the expendables unit has the expendables and in addition a liquid fuel storage section that stores a liquid fuel for the fuel cell.

According to the expendables unit of the present invention, the expendables unit has the expendables and in addition a liquid fuel storage section that stores a liquid fuel for the fuel cell. This feature makes it possible to supplement the liquid fuel to fuel cell by only exchange of expendables to be consumed in the equipment, for example, inks in case of a printer, without causing a user to be conscious of a supply of the liquid fuel to the fuel cell.

In the expendable unit according to the present invention as mentioned above, it is preferable that the fuel cell generates electricity upon receipt of supply of liquid fuel and creates liquid to be discharged, and the expendables unit has a discharged liquid storage section that stores a discharged liquid.

According to the present invention, the expendables unit has a discharged liquid storage section that stores a discharged liquid. Thus, when there is provided such an arrangement that the discharged liquid created in the fuel cell in the equipment is stored in the discharged liquid storage section, there is no need for a user to process the discharged liquid with being conscious of a generation of the discharged liquid, and thus there is provided a system excellent in operability.

In the expendable unit according to the present invention as mentioned above, it is preferable that the liquid fuel storage section and the discharged liquid storage section are separated by a flexible partition film.

According to the present invention, a flexible partition film separates the liquid fuel storage section and the discharged liquid storage section. This feature may vary capacities of the liquid fuel storage section and the discharged liquid storage section in accordance with consumption of the liquid fuel and increment of the discharged liquid, and thus it is possible to reduce the capacity of the expendable unit.

Further, to achieve the above-mentioned objects, the present invention provides equipment incorporating thereinto a fuel cell for generating electricity upon receipt of supply of liquid fuel, in which an expendables unit having expendables is mounted to supply expendables, and the equipment is operative by electric power from the fuel cell involving consumption of the expendables from the expendables unit, wherein the expendables unit has the expendables and in addition a liquid fuel storage section that stores a liquid fuel for the fuel cell, and wherein the equipment has a fuel supplying path for receiving supply of the liquid fuel from the mounted expendables unit.

According to the equipment of the present invention, it is possible to supplement the liquid fuel to fuel cell by only exchange of expendables to be consumed in the equipment, without causing a user to be conscious of a supply of the liquid fuel to the fuel cell.

In the equipment according to the present invention as mentioned above, it is preferable that the fuel cell generates electricity upon receipt of supply of the liquid fuel and creates liquid to be discharged, the expendables unit has a discharged liquid storage section that stores the discharged liquid created in the fuel cell, and the equipment further has a discharged liquid forwarding path for forwarding the discharged liquid created in the fuel cell to the mounted expendables unit.

In this case, there is no need to process the discharged liquid, it is possible to process the discharged liquid by only exchange of expendables to be consumed in the equipment. And thus there is provided the equipment excellent in operability.

Furthermore, to achieve the above-mentioned objects, the present invention provides a first printer incorporating thereinto a fuel cell for generating electricity upon receipt of supply of liquid fuel, in which the printer is operative by electric power from the fuel cell, and a detachable ink cartridge storing at least black ink is used to eject ink to a recording medium so that an image is recorded on the recording medium, wherein the ink cartridge stores together the liquid fuel for the fuel cell.

According to the present invention, the ink cartridge stores together the liquid fuel for the fuel cell. This feature makes it possible to supplement or abandon the liquid fuel on a batch basis with the expendables of the equipment.

To achieve the above-mentioned objects, the present invention provides a second printer incorporating thereinto a fuel cell for generating electricity upon receipt of supply of liquid fuel, in which an ink cartridge storing ink is mounted on a carriage, and a recording medium is moved in a process direction, while the carriage is moved in directions perpendicular to the process direction, and the ink stored in the ink cartridge is ejected to the recording medium so that an image is recorded on the recording medium, wherein the ink cartridge stores ink, and has a liquid fuel storage section that stores the liquid fuel, and a water storage section that stores water, and wherein the printer has:

the fuel cell having a fuel electrode, an air electrode, and a solid-electrolyte film, in which the fuel electrode receives the liquid fuel and water is discharged through the air electrode;

a fuel supplying path for supplying the liquid fuel stored in the liquid fuel storage section to the fuel electrode; and a water forwarding path for forwarding the water discharged from the air electrode to the water storage section.

According to the present invention, the second printer is provided with the fuel cell, and the fuel is supplied from the ink cartridge mounted on the cartridge, while the discharged water is returned to the ink cartridge. Thus, according to the second printer of the present invention, it is possible to perform a continuous printing for a long time even in place not available commercial electricity.

In the second printer according to the present invention as mentioned above, it is preferable that the liquid fuel storage section and the water storage section are separated by a flexible partition film.

According to the present invention, a flexible partition film separates the liquid fuel storage section and the water storage section. This feature may vary capacities of the liquid fuel storage section and the water storage section in accordance with consumption of the liquid fuel and increment of the discharged water, and thus it is possible to reduce the capacity of the ink cartridge.

In the second printer according to the present invention as mentioned above, it is acceptable that the liquid fuel storage section and the water storage section are connected to the fuel supplying path and the water forwarding path, respectively, when the carriage stands by at a predetermined standby position, and the liquid fuel storage section and the water storage section are disconnected from the fuel supplying path and the water forwarding path, respectively, when the carriage moves from the predetermined standby position.

This feature makes it possible to reduce fatigue due to movements of the fuel supplying path and the water forwarding path according to a movement of the carriage.

In the second printer according to the present invention as mentioned above, it is acceptable that the printer has on the water forwarding path a water tank for saving the water discharged from the air electrode, and a pump for forwarding the water saved in the water tank to the water storage section when the carriage stands by at the predetermined standby position.

This feature makes it possible to quickly forward the water to the ink cartridge when the carriage stands by at the standby position.

In the second printer according to the present invention as mentioned above, it is acceptable that the printer has on the fuel supplying path a fuel tank for saving the liquid fuel supplied from the liquid fuel supplying section and supplying the saved liquid fuel to the fuel electrode when the carriage stands by at the predetermined standby position.

The provision of the fuel tank always coupled to the fuel electrode makes it possible to supply a predetermined amount of fuel from the ink cartridge when the carriage stands by at the standby position.

In the second printer according to the present invention as mentioned above, it is acceptable that the ink cartridge has a sensor for detecting residue of the stored ink and liquid fuel.

This feature makes it possible to simultaneously manage the residue of the stored-ink and liquid fuel.

In the second printer according to the present invention as mentioned above, it is acceptable that the ink cartridge is of a cylindrical configuration, a bag-shaped configuration or a sheet-shaped configuration.

This feature makes it possible to optionally adjust capacity of the cartridge and also to apply it to a various type of printer.

DETAILED DESCRIPTION OF PREFERRED EMBODIMENTS

Embodiments of the present invention will be described with reference to the accompanying drawings.

Figure 1:
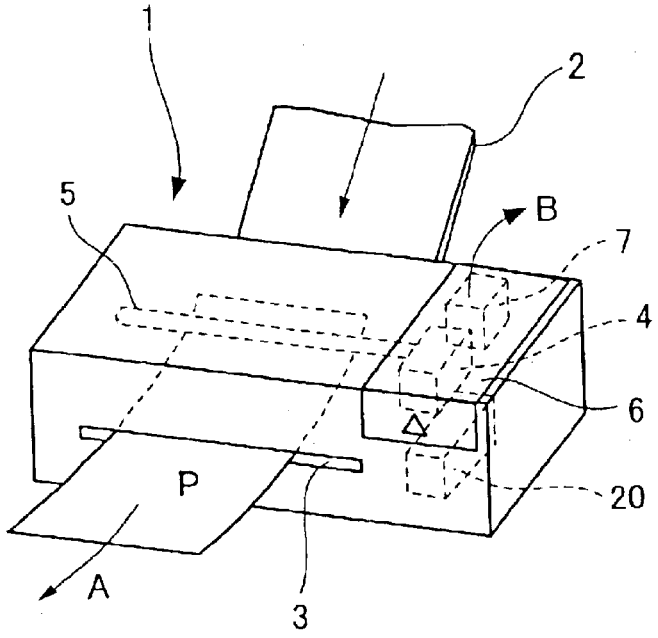
FIG. 1 is a schematic perspective view of a printer according to a first embodiment of the present invention.

FIG. 1 is a schematic perspective view of a printer according to a first embodiment of the present invention.

The printer shown in FIG. 1 is an embodiment of the printer of the present invention and also an embodiment of the equipment referred to in the present invention. An ink cartridge used in the printer shown in FIG. 1 includes an embodiment of the expendables unit referred to in the present invention.

The printer 1 shown in FIG. 1 comprises: a paper feed guide 2 into which a printing paper P is inserted; a paper discharge aperture 3 from which a printed paper is discharged; a carriage 4 onto which an ink cartridge is mounted; a guide bar 5 for guiding a movement of the carriage 4 in a direction perpendicular to a direction of an arrow A; a cover 6 for mounting the ink cartridge onto the carriage 4 standing by at one end of the guide bar 5, the cover 6 being able to be opened in a direction of an arrow B; a processing section 7 for converting a signal entered from the external into a driving signal causing ink to be ejected by a thermal effect; and a fuel cell 20. The printer 1 further comprises a recording head (not illustrated) for ejecting ink stored in the ink cartridge, the recording head being provided on a side adjacent to the paper P.

In the event that the printer 1 is used to perform printing on the paper P, the printing is performed, for example, in such a manner that a signal is entered through a personal computer to be subjected to an image processing with electricity generated by the fuel cell 20, and the paper P is moved in the direction of the arrow A and the carriage 4 is reciprocated along the guide bar 5 in a direction of the width of the paper P, while ink of the cartridge accommodated in the carriage 4 is ejected to the paper P in accordance with the thermal effect based on the signal subjected to the image processing, so that an image according to the entered signal is recorded on the paper P. When the printing is terminated, the carriage 4 stands by at one end of the guide bar 5 until the next printing instruction is generated.

Figure 2:
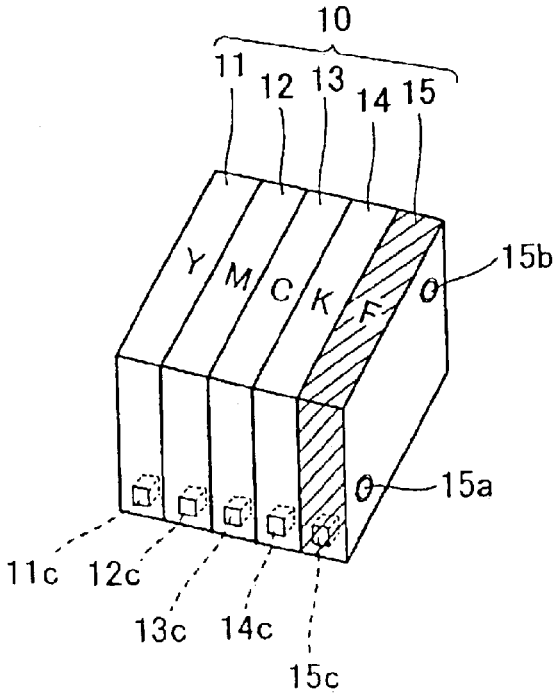
FIG. 2 is a schematic illustration of a cartridge storing inks and liquid fuels, which is used in the printer shown in FIG. 1.

FIG. 2 is a schematic illustration of a cartridge storing inks and liquid fuels, which is used in the printer shown in FIG. 1.

A cartridge 10 shown in FIG. 2 comprises a Y-cartridge 11 storing a yellow color of ink, an M-cartridge 12 storing a magenta color of ink, a C-cartridge 13 storing a cyan color of ink, a K-cartridge 14 storing a black color of ink, and an F-cartridge 15 storing a methanol fuel and also storing discharged water from the air electrode, which are arranged in the named order and formed into one united body.

The F-cartridge 15 has, at the lower left on a side opposite to a side adjacent to the K-cartridge 14, a supplying slot 15*a* for supplying the methanol fuel to the fuel electrode, and at the upper right a receiving slot 15*b* for receiving the discharged water from the air electrode.

The cartridges 11, 12, 13, 14 and 15 have sensors 11*c*, 12*c*, 13*c*, 11*c* and 15*c*, respectively, which are operative when inks or methanol fuel stored in the cartridges are consumed and a liquid surface becomes below a predetermined level. When the sensor is operated, the information is transmitted via a connector (not illustrated) connected to the carriage 4 to the processing section 7, and is displayed on an alarm basis on the printer 1 or a personal computer connected to the personal computer.

While the YMCK cartridges 11 to 14 are provided in form of a united body of ink cartridge 10, it is acceptable that the YMC cartridges 11 to 13 are provided in form of a united body, and the K cartridge 14 and the F cartridge 15 are provided in form of a united body. Capacity of the cartridges 11 to 15 can be optionally set up in accordance with an amount of use of the respective ink.

It is preferable that capacity of the F cartridge 15 is set up so as to store fuel or N times of the fuel where N: integer enough for printing until ink stored in the K cartridge 14 is exhausted, or until any one of inks stored in the YMC cartridges 11 to 13 is exhausted, when the printer 1 shown in FIG. 1 is operated by the liquid fuel stored in the F cartridge 15.

Such setting up of the F cartridge 15 makes it possible to supplement and discharge inks and methanol fuel as expendables on a batch basis.

Figure 3:
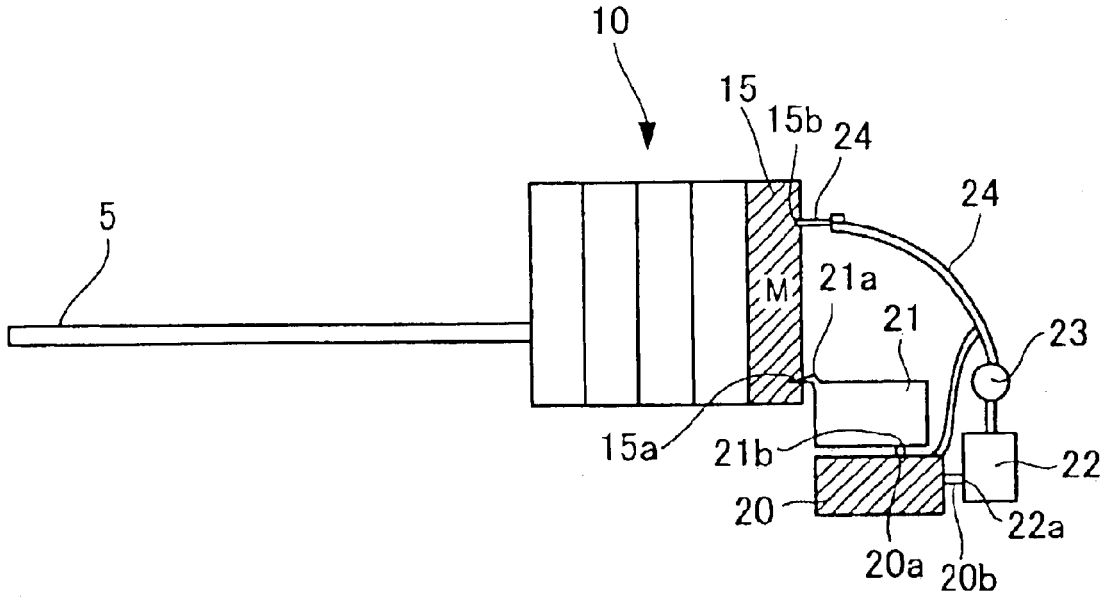
FIG. 3 is a view useful for understanding a state of connection of a fuel cell with an F-cartridge.

FIG. 3 is a view useful for understanding a state of connection of a fuel cell with an F-cartridge. Incidentally, a principle of the fuel cell will be explained later.

As shown in FIG. 3, the carriage (omitted for the convenience of the explanation) stands by at a predetermined standby position in the right end of guide bar 5. A fuel cell 20 supplies electricity necessary for recording of an image by the printer, and has a fuel electrode, an air electrode and a solid-electrolyte film. In the fuel cell 20, liquid fuel is supplied to the fuel electrode and water is discharged from the air electrode. A fuel sub-tank 21 supplies the liquid fuel to the fuel electrode. A water tank 22 saves water discharged from the air electrode. A water supplying pump 23 supplies, of the water saved in the water tank 22, reaction water to the fuel electrode, and water excepting the reaction water to the F cartridge 15. The water supplying pump 23 is coupled with the F cartridge 15 by a pipe 24.

The fuel sub-tank 21 has a nozzle 21*a* provided on the side thereof, which is to be inserted into the supplying slot 15*a* provided on the lower portion of the side of the F cartridge 15 accommodated in the carriage, and a supplying slot 21*b* provided on the bottom thereof, to which a nozzle 20*a* provided on the fuel electrode of the fuel cell 20 is to be inserted.

The fuel cell 20 further has a nozzle 20*b* for discharging water from the air electrode, which is inserted into a receiving slot 22*a* provided on the side of the water tank 22, as well as the nozzle 20*a* provided on the fuel electrode.

On the top of the pipe 24 coupling the water supplying pump 23 with the F cartridge 15, there is provided a nozzle 24*a* which is to be inserted into the receiving slot 15*b* of the F-cartridge.

When the carriage stands by at the standby position, the F-cartridge 15 moves to the end of the guide bar 5. Thus, the nozzle 21*a* of the fuel sub-tank 21 is inserted into the supplying slot 15*a* of the F cartridge 15 so that the liquid fuel is supplied to the fuel sub-tank 21, and the nozzle 24*a*, which is provided on the top of the pipe 24 coupling the water supplying pump 23 with the F cartridge 15, is inserted into the receiving slot 15*b* of the F-cartridge, so that water stored in the water tank 22 is supplied to the F cartridge 15. When the printing starts and the carriage moves from the standby position, the nozzles 21*a* and 24*a*, which are inserted into the supplying slot 15*a* and the receiving slot 15*b* of the F cartridge 15, respectively, are separated from the supplying slot 15*a* and the receiving slot 15*b*, respectively. At that time, of the water to be discharged from the air electrode, water excepting reaction water to be supplied to the fuel electrode is temporarily saved in the water tank 22, until the carriage again stands by at the standby position, and the liquid fuel saved in the fuel sub-tank 21 is supplied to the fuel electrode, until the carriage again stands by at the standby position.

A supply of the liquid fuel from the F cartridge 15 to the fuel sub-tank 21 and a supply of the liquid fuel from the fuel sub-tank 21 to fuel electrode are implemented by utilization of gravity of the liquid fuel. Water of the water tank 22 is supplied by the pump 23 to the fuel electrode of the fuel cell 20 and the F cartridge 15.

Figure 4:
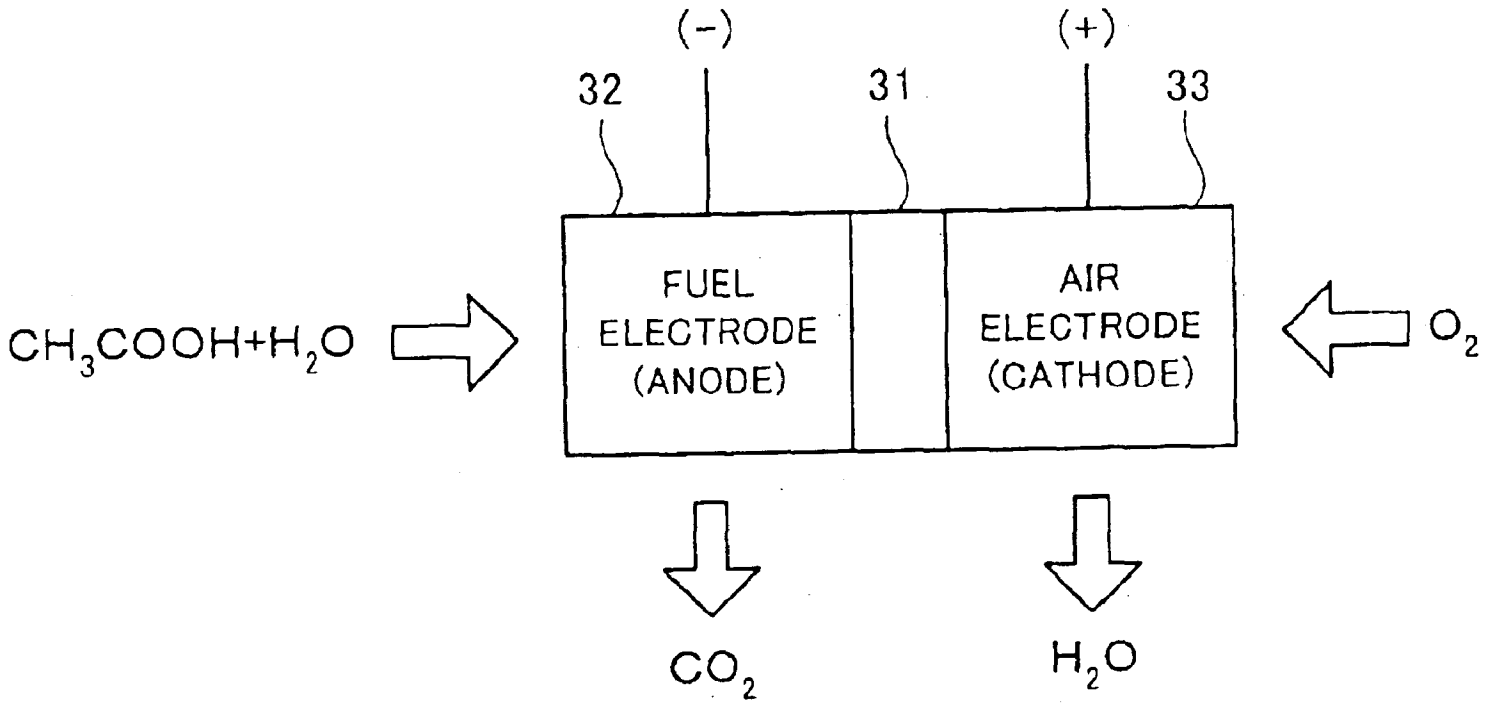
FIG. 4 is an explanatory view useful for understanding the principle of a fuel cell adopted in the present embodiment.

FIG. 4 is an explanatory view useful for understanding the principle of a fuel cell adopted in the present embodiment.

The fuel cell of FIG. 4 is a direct methanol fuel cell in which generation of electricity is performed by a chemical reaction of methanol ($CH_3COOH$), water ($H_2O$) and oxygen ($O_2$).

The direct methanol fuel cell has a structure that a proton conductive film 31 as a solid-electrolyte film is interposed between a fuel electrode (anode) 32 and an air electrode (cathode) 33. Methanol and water ($CH_3COOH+H_2O$) are separated by a catalyst effect on the fuel electrode (anode) 32 into hydrogen ions ($H^+$), electrons ($e^-$), and carbon dioxide ($CO_2$). Carbon dioxide ($CO_2$) is emitted from the fuel electrode (anode) 32. Hydrogen ions ($H^+$) travel in the proton conductive film 31 to the air electrode (cathode) 33, and are coupled with oxygen ($O_2$) to create water ($H_2O$). The water ($H_2O$) thus created is discharged fromithe air electrode (cathode) 33. The electrons ($e^-$) created by a reaction on the fuel electrode (anode) 32 cause a current to conduct between the air electrode (cathode) 33 and the fuel electrode (anode) 32. Thus the direct methanol fuel cell generates electricity.

Figure 5:
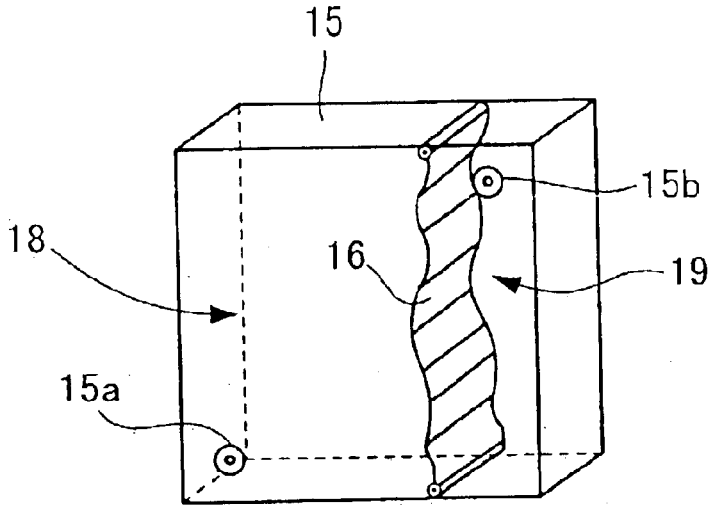
FIG. 5 is a view showing an internal structure of an F-cartridge.

FIG. 5 is a view showing an internal structure of an F-cartridge.

According to the F cartridge 15 shown in FIG. 5, there is provided at the upper right the receiving slot 15*b* for receiving water, and there is provided at the lower left the supplying slot 15*a* for supplying liquid fuel. The inside of the F cartridge 15 is divided by a flexible film 16 into a liquid fuel storage section 18 for storing liquid fuel and a water storage section 19 for storing water. The flexible film 16 is fixed on the inner wall of the F cartridge 15. When the cartridge is mounted on the photo-printer, at the first, the cartridge is filled with the liquid fuel, and thus the film 16 is urged to the right and is pushed to the wall of the right side. However, as the liquid fuel is consumed, water from the air electrode flows through the receiving slot 15*b* into the F cartridge 15. As the volume of the water is increased more than the volume of the liquid fuel, the film 16 is urged to the left.

In this manner, the inside of the F cartridge 15 is divided by the flexible film 16 into the liquid fuel storage section 18 and the water storage section 19. And the volumes of the liquid fuel storage section 18 and the water storage section 19 are varied in accordance with the consumption of the liquid fuel and the increment of the discharged water. Thus, it is possible to reduce the volume of the F cartridge 15.

The supplying slot 15*a* for liquid fuel is sealed when the ink cartridge 10 including the F cartridge 15 is in the unused state. The seal is broken when the ink cartridge 10 is mounted onto a printer. The receiving slot 15*b* for water has a valve structure to prevent water from being leaked.

Figure 6:
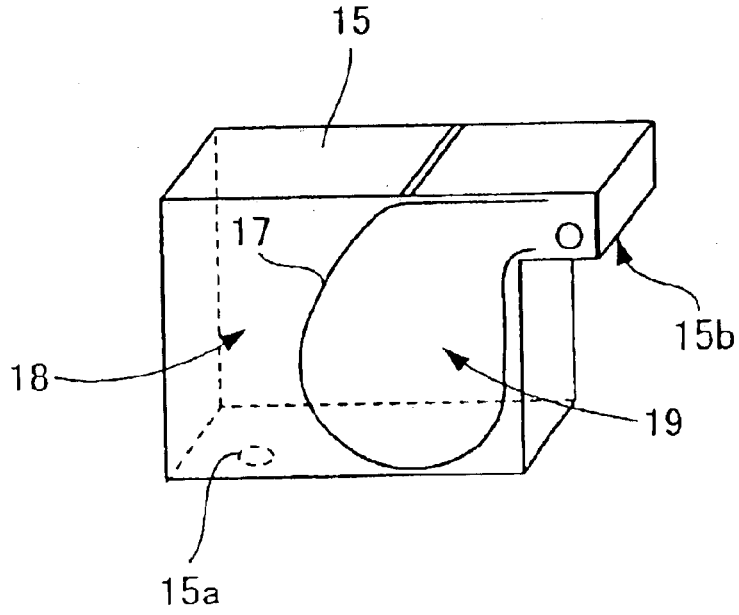
FIG. 6 is a view showing another embodiment of the F-cartridge.

FIG. 6 is a view showing another embodiment of the F cartridge.

On the bottom of the F cartridge shown in FIG. 6, there is provided a supplying slot 15*a* for supplying the liquid fuel. On the bottom of a right projecting portion of the F cartridge shown in FIG. 6, there is provided a receiving slot 15*b* for water (which does not appear in the figure). On the receiving slot 15*b* for water, there is mounted a flexible rubber bag 17 that becomes larger in its capacity as water flows therein. Accordingly, at the first when the cartridge is mounted on the printer, the cartridge is filled with the liquid fuel, and thus the rubber bag 17 shrinks. On the other hand, the liquid fuel is consumed, so that the discharged water of the air electrode flows from the receiving slot 15*b* into the F cartridge, the rubber bag 17 gradually expands.

Regarding a matter that the supplying slot 15*a* is sealed when the F cartridge is in the unused state, and a matter that the receiving slot 15*b* for water has the valve structure, those are the same as the matters of the example of FIG. 5. This is the same regarding the expendables unit such as the ink cartridge, which will be explained in conjunction with FIG. 7 and the following figures.

According to the printer of the present embodiment, the liquid fuel of the fuel cell is stored in the F cartridge 15, and is mounted in form of an ink cartridge on the carriage in united body so as to be supplied to the fuel cell, and water discharged from the fuel cell is returned to the F cartridge 15. This feature makes water processing easy, and also makes it possible to perform residual control, supplementation and abandonment for ink and fuel as expendables on a batch base.

According to the present embodiment as mentioned above, there is provided an arrangement that when the carriage stands by at the standby position, the F cartridge is connected to the fuel supplying path and the water supplying path, and when the carriage moves from the standby position, the F cartridge is disconnected from the fuel supplying path and the water supplying path. However, there is no need for the present invention to provide such an arrangement. It is acceptable for the present invention that the F cartridge is always connected to the fuel supplying path and the water supplying path, and those elements move in accordance with the movement of the carriage. It is hot always necessary for the present invention to provide the water tank and the fuel tank.

Next, there will be explained various examples of the ink cartridge.

Figure 7:
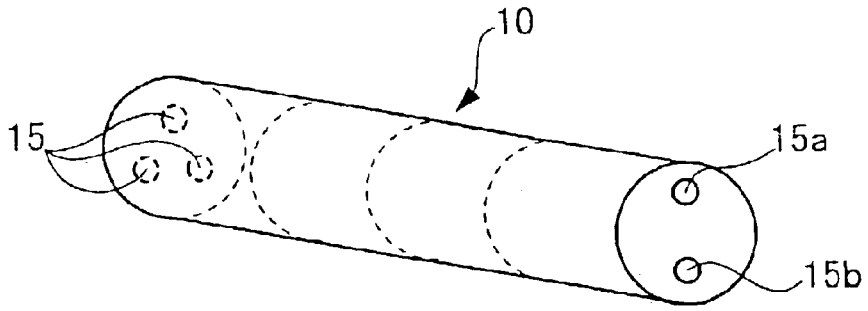
FIG. 7 is a view showing an embodiment of an ink cartridge.

FIG. 7 is a view showing an embodiment of an ink cartridge.

As shown in FIG. 7, an ink cartridge 10 has a cylindrical configuration. The inside of the ink cartridge 10 is divided into a plurality spaces to store black ink, color inks and liquid fuel. On the one side of the ink cartridge 10, there is provided a plurality of ink supplying slots 15, and on another side of the ink cartridge 10, there are provided a supplying slot 15*a* for liquid fuel and a receiving slot for water 15*b*.

This configuration of the ink cartridge 10 makes it possible to apply the ink cartridge 10 to a compact printer.

Figure 8:
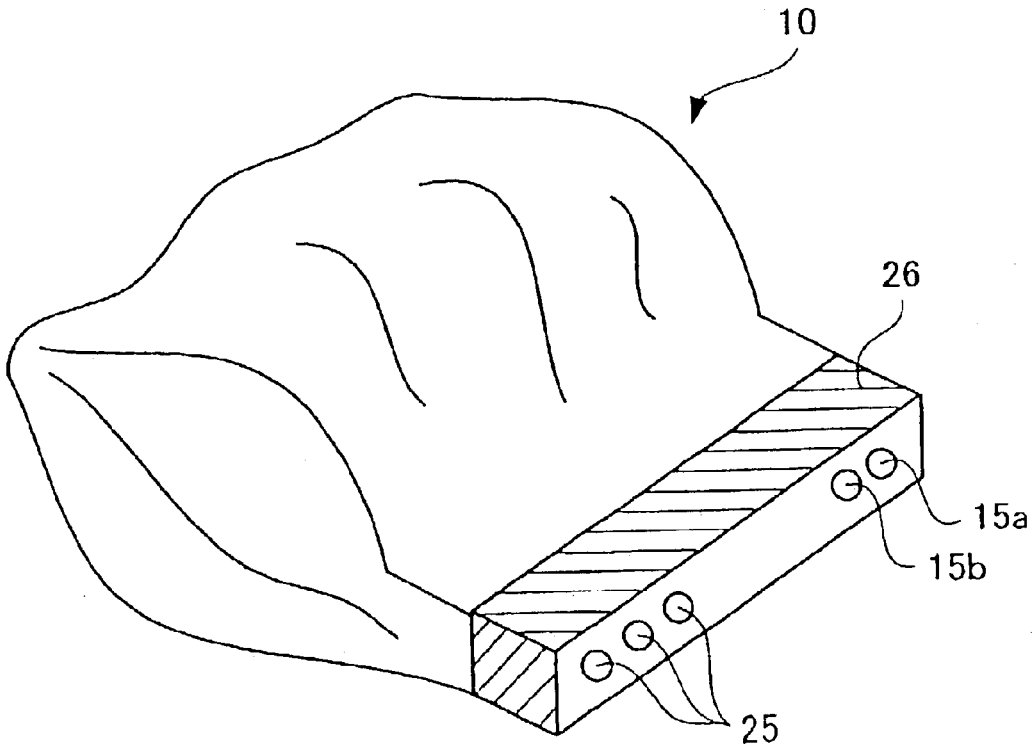
FIG. 8 is a view showing another embodiment of the ink cartridge.

FIG. 8 is a view showing another embodiment of the ink cartridge.

As shown in FIG. 8, an ink cartridge 10 has a bag configuration. The inside of the ink cartridge 10 is divided into a plurality spaces to store black ink, color inks and liquid fuel. On the inlet of the ink cartridge 10, there is mounted a binder 26. On the binder 26, there are provided a plurality of ink supplying slots 25, a supplying slot 15*a* for liquid fuel and a receiving slot for water 15*b*.

This configuration of the ink cartridge 10 makes it possible to store a relatively large capacity of ink even if the ink cartridge 10 is set up to a narrow space.

Figure 9:
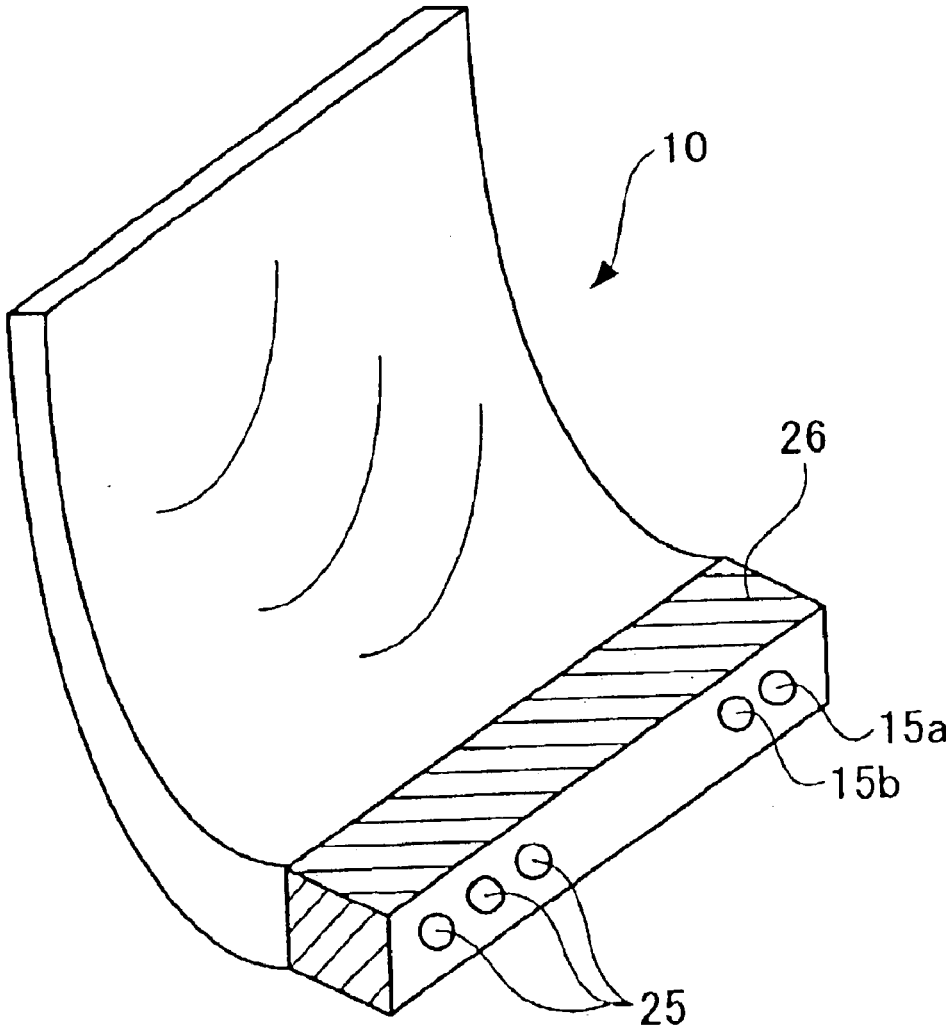
FIG. 9 is a view showing further another embodiment of the ink cartridge.

FIG. 9 is a view showing further another embodiment of the ink cartridge.

As shown in FIG. 9, an ink cartridge 10 has a curled sheet configuration. The inside of the ink cartridge 10 is divided into a plurality spaces to store black ink, color inks and liquid fuel. On the inlet of the ink cartridge 10, there is mounted a binder 26. On the binder 26, there are provided a plurality of ink supplying slots 25, a supplying slot 15*a* for liquid fuel and a receiving slot for water 15*b*.

This configuration of the ink cartridge 10 makes it possible to set up the ink cartridge 10 to a narrow space.

The various examples of the ink cartridge as mentioned above are used to the printer shown in FIG. 1, or printers which are the same as the printer shown in FIG. 1 in principle but different in a mounting mechanism of the ink cartridge and a connecting form of the ink cartridge with the fuel cell. Next, hereinafter, there will be explained expendables units, which are quite different from the above-mentioned ink cartridges.

Figure 10:
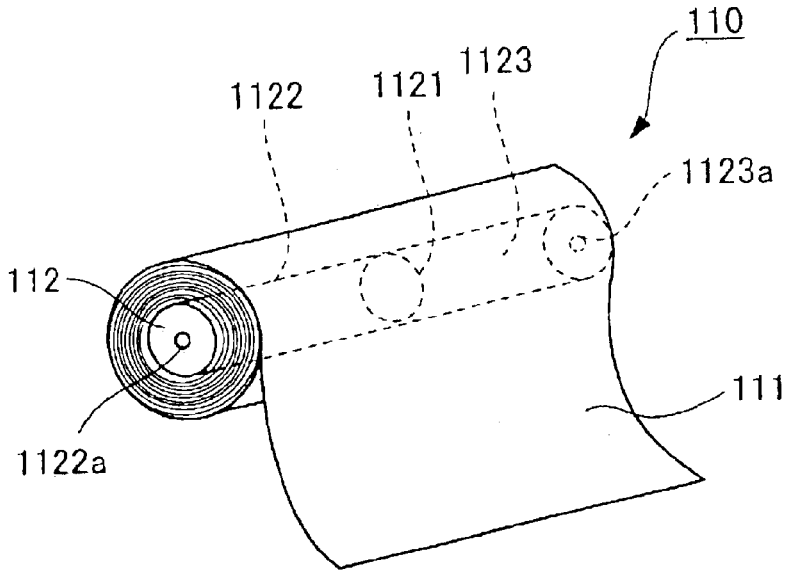
FIG. 10 is a view showing a roll paper unit having a roll paper as expendables.

FIG. 10 is a view showing a roll paper unit having a roll paper as expendables.

While the printer shown in FIG. 1 is concerned with a printer using a printing paper shaped as a sheet, there exist many types of printers using a roll paper.

A roll paper unit 110 in FIG. 10 is suitable for a printer using such a roll paper and being loaded with a fuel cell.

The roll paper unit 110 is so arranged that a long paper 11*l* is wound onto a winding core 112 having a hollow structure. The winding core 112 is divided at the substantially center portion inside the hollowness of the winding core 112 with a separating wall 1121 to form a liquid fuel storage section 1122 for storing liquid fuel and a water storage section 1123 for storing water. At the centers of both the edges of the winding core 112, there is formed at the side of the liquid fuel storage section 1122 a supplying slot 1122*a* for supplying the liquid fuel to the fuel cell mounted on a printer, and there is formed at the side of the water storage section 1123 a receiving slot 1123*a* for receiving the water created in the fuel cell, respectively. The supplying slot 1122*a* is sealed when the roll paper unit 110 is in the unused state. And an opening of the supplying slot 1122*a* is formed when the roll paper unit 110 is mounted on the printer. According to the roll paper unit 110, hollow pipes coupled with the fuel cell of the printer are inserted into the supplying slot 1122*a* and the receiving slot 1123*a* of the winding core 112, respectively, so that there are formed a fuel supplying path for supplying liquid fuel to the fuel cell and a discharged water supplying path for discharging water created in the fuel cell, and the winding core 112 becomes rotatable on the hollow pipes. Thus, the roll paper unit 110 rotates when the paper 111 is drawn, so that the paper 111 is supplied to the printer. The receiving slot 1123*a* has a valve structure. Thus, while water flows from the receiving slot 1123*a* into the water storage section 1123, it is prevented that water of the water storage section 1123 flows out through the receiving slot 1123*a*.

Figure 11:
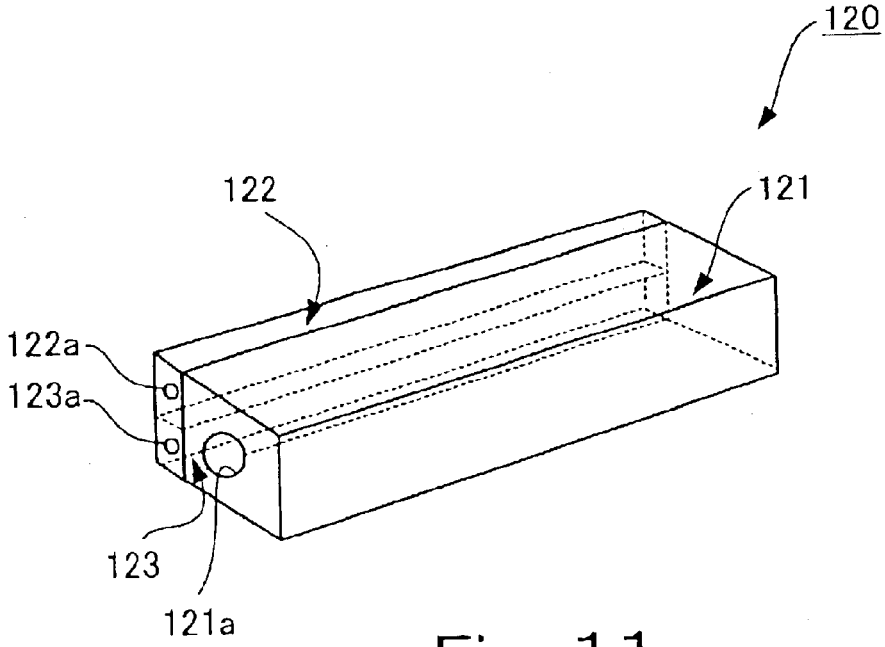
FIG. 11 is a view showing a toner cartridge having a toner as expendables.

FIG. 11 is a view showing a toner cartridge having a toner (powder ink) as expendables.

In a copying machine and a laser printer, an electrophotographic system is often used. According to the electrophotographic system: a latent image, which consists of an electrostatic potential distribution, is formed on a predetermined photoreceptor drum and the like; a toner image is formed through development of the latent image by a toner as the powder ink; and the toner image is finally transferred to a paper and is fixed on the paper by means of for example melting the toner by heat and cooling the toner, so that an image consisting of the fixed toner image is formed on the paper. In the copying machine and the laser printer according to the electrophotographic system as mentioned above, the toner, as the expendables, is consumed, and thus there is a need to supply the toner. Accordingly, for the sake of convenience, a cartridge type of one storing a toner (a toner cartridge) is often used.

A toner cartridge 120 shown in FIG. 11 is suitable for a case where the copying machine and the laser printer according to the electrophotographic system is loaded with a fuel cell.

The toner cartridge 120 shown in FIG. 11 comprises a toner storage chamber 121 for storing a toner, a liquid fuel storage chamber 122 for storing a liquid fuel, and a discharged water storage chamber 123 for storing discharged water. When the toner cartridge 120 is unused, the toner storage chamber 121 is filled with the toner, and the liquid fuel storage chamber 122 is filled with the liquid fuel. On the other hand, the discharged water storage chamber 123 is vacant. On the toner storage chamber 121, there is provided a toner supplying slot 121*a* for supplying the toner of the toner storage chamber 121 to a copying machine or a laser printer, which are loaded with the toner cartridge 120. On the liquid fuel storage chamber 122, there is provided a fuel supplying slot 122*a* for supplying liquid fuel to a fuel cell incorporated in the copying machine or the laser printer. On the discharged water storage chamber 123, there is provided a discharged water receiving slot 123*a*. Of the toner supplying slot 121*a*, the fuel supplying slot 122*a* and the discharged water receiving slot 123*a*, the toner supplying slot 121*a* and the fuel supplying slot 122*a* are sealed to prevent the toner and the liquid fuel from being leaked before the use, and are formed with openings when the toner cartridge 120 is mounted on the copying machine or the laser printer.

When the toner cartridge 120 of FIG. 11 is mounted, a liquid fuel in the liquid fuel storage chamber 122 constituting the toner cartridge 120 is supplied to the fuel cell incorporated in the mounted copying machine or laser printer, and water created in the fuel cell is stored in the discharged water storage chamber 123 of the toner cartridge 120. The discharged water receiving slot 123*a* has a valve structure to prevent water stored in the discharged water storage chamber 123 from being leaked through the discharged water receiving slot 123*a*.

Figure 12:
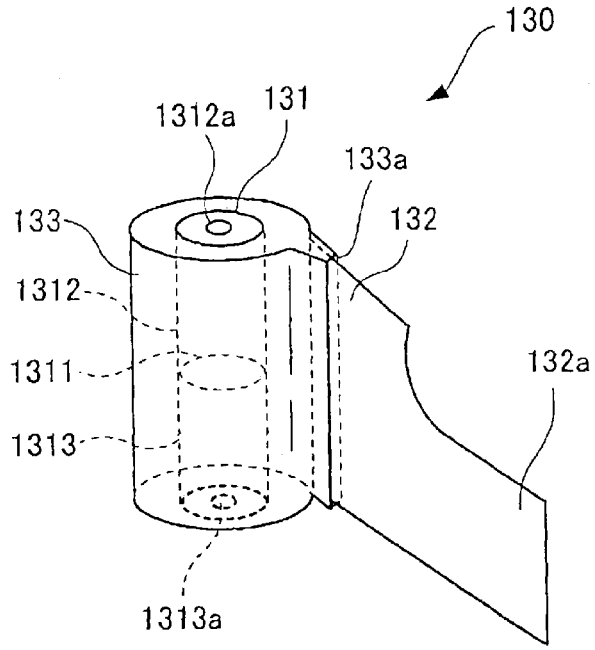
FIG. 12 is a view showing Patrone storing a wound photographic film as expendables.

FIG. 12 is a view showing Patrone storing a wound photographic film as expendables.

A Patrone 130 is so arranged that a long photographic film 132 is wound around a winding core 131 and is covered by a case 133 having a light shielding structure. FIG. 12 shows a state that a head portion 132*a* of the photographic film 132 is exposed from a film-taking out slot 133*a* having a light shielding structure, of the case 133.

Recently, while such a type of digital camera that image data is created by a solid state imaging device has come into wide use rapidly, there is widely used such a type of camera that a Patrone is mounted and a photographic film wound around the Patrone is pulled out to perform a photography on the photographic film.

The Patrone 130 shown in FIG. 12 is suitable for a case where a fuel cell is loaded on such a type of camera as mentioned above.

The winding core 131 of the Patrone 130 has a hollow vessel. Inside of the hollow vessel is divided by a central partition wall 1311 into two chambers of a liquid fuel storage chamber 1312 and a discharged water storage chamber 1313. The liquid fuel storage chamber 1312 stores a liquid fuel. The discharged water storage chamber 1313 is vacant in the unused state to receive discharged water when it is used. On the liquid fuel storage chamber 1312, there is formed a fuel supplying slot 1312*a* sealed in the unused state, on a rotary shaft of the winding core. On the discharged water storage chamber 1313, there is formed a discharged water receiving slot 1313*a* on the rotary shaft of the winding core.

When the Patrone 130 is mounted on a camera loading a fuel cell, the fuel supplying slot 1312*a* is formed with an opening, and the fuel supplying slot 1312*a* and the discharged water receiving slot 1313*a* are connected with the fuel cell incorporated in the camera in the state that the winding core 131 is rotatable, so that the liquid fuel is supplied from the fuel supplying slot 1312*a* to the fuel cell and the discharged water created in the fuel cell flows from the discharged water receiving slot 1313*a* into the discharged water storage chamber 1313. The discharged water receiving slot 1313*a* has a valve structure to prevent water stored in the discharged water storage chamber 1313 from being leaked through the discharged water receiving slot 1313*a* even after the Patrone is removed from the camera.

Figure 13:
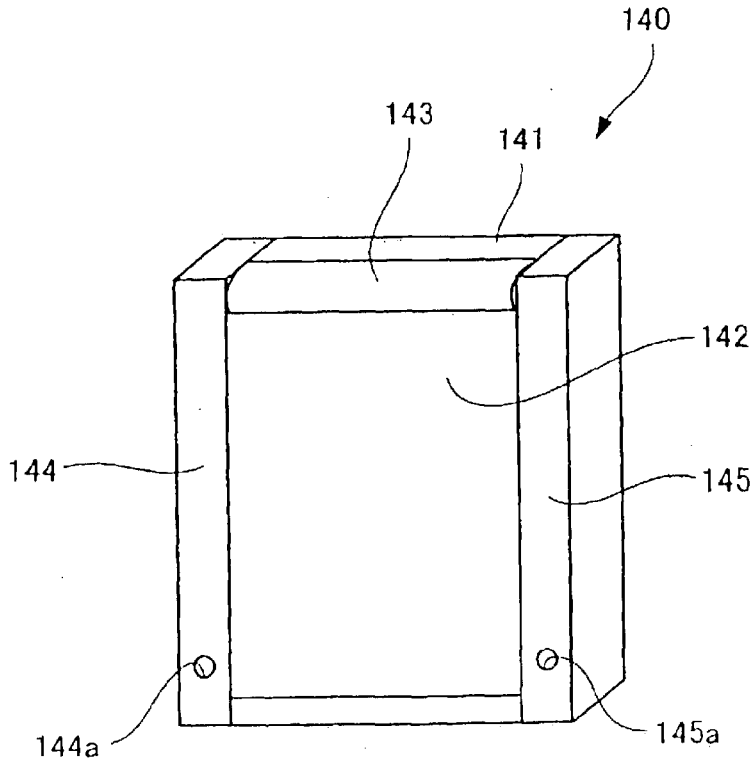
FIG. 13 is a view showing an instant photographic sheet cartridge storing laminated an instant photographic sheet as expendables.

FIG. 13 is a view showing an instant photographic sheet cartridge storing laminated an instant photographic sheet as expendables.

There is also widely used an instant camera in which an instant photographic sheet cartridge storing instant photographic sheets in form of lamination is mounted and a photography is performed on the instant photographic sheets of the instant photographic sheet cartridge.

The instant photographic sheet has a photoconductive surface to be exposed by photography and a developer storage section for storing developer at the position adjacent to the photoconductive surface. The instant camera performs photography on the photoconductive surface of the instant photographic sheet and feeds the instant photographic sheet subjected to the photography out of the instant camera. The instant camera is such a type of camera that when the instant photographic sheet is fed out of the instant camera, the developer stored in the developer storage section is developed on the photoconductive surface to perform a photographic development. Photograph will appear for instance several minutes or so on the instant photographic sheet fed out of the instant camera.

An instant photographic sheet cartridge 140 shown in FIG. 13 is suitable for a case where a fuel cell is loaded onto such a type of instant camera.

Inside a case 141 of the instant photographic sheet cartridge 140 shown in FIG. 13, ten instant photographic sheets (not illustrated) are laminated, and the front of the case 141 is covered with a light shielding cover 142. An aperture between the case 141 and the light shielding cover 142 is sealed with a light shielding seal 143 to prevent light from entering through a small gap between the case 141 and the light shielding cover 142.

When the instant photographic sheet cartridge 140 is mounted on the instant camera, first, the light shielding cover 142 pushes the seal 143 aside to drive the case 141 from the instant camera while the seal 143 is taken off from the seal 143. Then, on a plane covered by the light shielding cover 142, there appears a photoconductive surface of a first instant photographic sheet. When photography is performed on the first instant photographic sheet in accordance with the photographic operation, the first instant photographic sheet is derived from the instant camera and is developed so that a photograph appears on the derived first instant photographic sheet. This derivation causes a photoconductive surface of a second instant photographic sheet to appear on the plane covered by the light shielding cover 142 in the state shown in FIG. 13, of the instant photographic sheet cartridge 140. Repetition of this operation makes it possible to perform photography on ten instant photographic sheets.

The instant photographic sheet cartridge 140 shown in FIG. 13 comprises a liquid fuel storage section 144 of which the inside is formed with a hollowness and a discharged water storage section 145 of which the inside is formed with a hollowness. The hollow inside of the liquid fuel storage section 144 is filled with the liquid fuel. Under the liquid fuel storage section 144, there is provided a fuel supplying slot 144*a* for supplying liquid fuel to a fuel cell incorporated in the instant camera. The fuel supplying slot 144*a* is sealed to prevent the liquid fuel from being leaked, before it is mounted on the instant camera.

Under the discharged water storage section 145, there is provided a discharged water receiving slot 145*a* for receiving water created in the fuel cell incorporated in the instant camera into the discharged water storage section 145. The discharged water receiving slot 145*a* has a valve structure to prevent water stored in the discharged water storage section 145 from being leaked through the discharged water receiving slot 145*a*.

When the instant photographic sheet cartridge 140 shown in FIG. 13 is mounted on the instant camera, the fuel supplying slot 144*a* and the discharged water receiving slot 145*a* are connected to the fuel cell of the instant camera, so that the liquid fuel stored in the liquid fuel storage section 144 is supplied via the fuel supplying slot 144*a* to the fuel cell, and the water created in the fuel cell is stored via the discharged water receiving slot 145*a* in the discharged water storage section 145.

As apparent from the above-mentioned various embodiments, the expendables referred to in the present invention is not restricted to the specified expendables, and any one is the object, as the expendables, which are consumed in equipment to which the expendables unit is mounted. Further, likely, the equipment referred to in the present invention is not restricted to the specified equipment, and any one is the object, as the equipment, which is operative as expendables are consumed incorporating a fuel cell. The equipment referred to in the present invention is provided with a fuel cell. However, there is no need that the equipment is one which is operative with electricity from the fuel cell only, and it is acceptable that the equipment is one which is operative with a commercial AC power source for example, and uses the fuel cell when the commercial AC power source is not available.

While the above explanation has been made assuming that as the fuel cell, the direct methanol fuel cell is used and the fuel cell creates water, the fuel cell referred to in the present invention is not restricted to the specific type of fuel cell, and also the discharged liquid created in the fuel cell is not restricted to the water.

The above explanation has been made about the storage sections for discharged liquid and water. However, in case of the small type of equipment, it often happens that little discharged liquid and water are concerned. In view of this matter, it is acceptable that the storage sections for discharged liquid and water are not always the vessels and are absorption type of storage sections such as high water absorption properties of polymer. As materials of the high water absorption properties of polymer, there are considered polyvinyl alcohol/polyacrylic acid containing materials.

As mentioned above, according to the present invention, it is possible to provide equipment capable of supplying liquid fuel by only exchange of expendables to be consumed in the equipment without causing a user to be conscious of a supply of the liquid fuel to a fuel cell, and the equipment being excellent in operability and being operable for long time even under the environment that the commercial AC power source is not available, and an expendables unit suitable for such equipment.

While the present invention has been described with reference to the particular illustrative embodiments, it is not to be restricted by those embodiments but only by the appended claims. It is to be appreciated that those skilled in the art can change or modify the embodiments without departing from the scope and sprit of the present invention.

What is claimed is:

1. An expendables unit mounted on an equipment comprising a fuel cell for generating electricity upon receipt of supply of liquid fuel, in which the equipment is operative by electric power from the fuel cell involving consumption of expendables, the expendables unit supplying the expendables to the equipment, wherein the expendables unit has the expendables and in addition a liquid fuel storage section that stores a liquid fuel for the fuel cell.

2. An expendables unit according to claim 1, wherein the fuel cell generates electricity upon receipt of supply of liquid fuel and creates liquid to be discharged, and the expendables unit has a discharged liquid storage section that stores a discharged liquid.

3. An expendables unit according to claim 2, wherein the liquid fuel storage section and the discharged liquid storage section are separated by a flexible partition film.

4. The equipment incorporating thereinto a fuel cell for generating electricity upon receipt of supply of liquid fuel, comprising an expendables unit having expendables is mounted on the equipment to supply expendables, and the equipment is operative by electric power from the fuel cell involving consumption of the expendables from the expendables unit, wherein the expendables unit has the expendables and in addition a liquid fuel storage section that stores a liquid fuel for the fuel cell, and wherein the equipment has a fuel supplying path for receiving supply of the liquid fuel from the mounted expendables unit.

5. The equipment according to claim 4, wherein the fuel cell generates electricity upon receipt of supply of the liquid fuel and creates liquid to be discharged, the expendables unit has a discharged liquid storage section that stores the discharged liquid created in the fuel cell, and the equipment further has a discharged liquid forwarding path for forwarding the discharged liquid created in the fuel cell to the mounted expendables unit.

6. A printer comprising a fuel cell for generating electricity upon receipt of supply of liquid fuel, in which the printer is operative by electric power from the fuel cell, and a detachable ink cartridge storing at least black ink is used to eject ink to a recording medium so that an image is recorded on the recording medium, wherein the ink cartridge stores together the liquid fuel for the fuel cell.

7. A printer comprising a fuel cell for generating electricity upon receipt of supply of liquid fuel, in which an ink cartridge storing ink is mounted on a carriage, and a recording medium is moved in a process direction, while the carriage is moved in directions perpendicular to the process direction, and the ink stored in the ink cartridge is ejected to the recording medium so that an image is recorded on the recording medium, wherein the ink cartridge stores ink, and has a liquid fuel storage section that stores the liquid fuel, and a water storage section that stores water, and wherein the printer has:

the fuel cell having a fuel electrode, an air electrode, and a solid-electrolyte film, in which the fuel electrode receives the liquid fuel and water is discharged through the air electrode;

a fuel supplying path for supplying the liquid fuel stored in the liquid fuel storage section to the fuel electrode; and a water forwarding path for forwarding the water discharged from the air electrode to the water storage section.

8. A printer according to claim 7, wherein the liquid fuel storage section and the water storage section are separated by a flexible partition film.

9. A printer according to claim 7, wherein the liquid fuel storage section and the water storage section are connected to the fuel supplying path and the water forwarding path, respectively, when the carriage stands by at a predetermined standby position, and the liquid fuel storage section and the water storage section are disconnected from the fuel supplying path and the water forwarding path, respectively, when the carriage moves from the predetermined standby position.

10. A printer according to claim 9, wherein the printer has on the water forwarding path a water tank for saving the water discharged from the air electrode, and a pump for forwarding the water saved in the water tank to the water storage section when the carriage stands by at the predetermined standby position.

11. A printer according to claim 9, wherein the printer has on the fuel supplying path a fuel tank for saving the liquid fuel supplied from the liquid fuel supplying section and supplying the saved liquid fuel to the fuel electrode when the carriage stands by at the predetermined standby position.

12. A printer according to claim 7, wherein the ink cartridge has a sensor for detecting residue of the stored ink and liquid fuel.

13. A printer according to claim 7, wherein the ink cartridge is of a cylindrical configuration, a bag-shaped configuration or a sheet-shaped configuration.

* * * * *